US008992190B2

(12) United States Patent
Okazono et al.

(10) Patent No.: US 8,992,190 B2
(45) Date of Patent: Mar. 31, 2015

(54) FUEL FEED APPARATUS

(75) Inventors: Tetsuro Okazono, Okazaki (JP); Shinobu Oikawa, Kariya (JP); Hironobu Oki, Oyama (JP)

(73) Assignees: Denso Corporation, Kariya (JP); Kyosan Denki Co., Ltd., Koga (JP)

( * ) Notice: Subject to any disclaimer, the term of this patent is extended or adjusted under 35 U.S.C. 154(b) by 484 days.

(21) Appl. No.: 13/230,076

(22) Filed: Sep. 12, 2011

(65) Prior Publication Data

US 2012/0063938 A1 Mar. 15, 2012

(30) Foreign Application Priority Data

Sep. 13, 2010 (JP) ..... 2010-204623
Feb. 7, 2011 (JP) ..... 2011-24340
May 17, 2011 (JP) ..... 2011-110618

(51) Int. Cl.
*F04B 17/03* (2006.01)
*F02M 37/10* (2006.01)
*F02M 37/02* (2006.01)

(52) U.S. Cl.
CPC ..... *F02M 37/106* (2013.01); *F02M 37/103* (2013.01); *F02M 37/025* (2013.01)
USPC ..... 417/423.3; 417/423.15; 137/590; 137/565.17

(58) Field of Classification Search
CPC . F02M 37/106; F02M 37/103; F02M 37/025; F04D 29/607
USPC ..... 417/423.3, 423.15, 363, 423.9; 137/590, 565.17; 123/509, 518
See application file for complete search history.

(56) References Cited

U.S. PATENT DOCUMENTS

| | | | | |
|---|---|---|---|---|
| 4,362,476 | A * | 12/1982 | Kemmner et al. | 417/360 |
| 4,865,522 | A * | 9/1989 | Radermacher | 417/203 |
| 5,875,816 | A * | 3/1999 | Frank et al. | 137/549 |
| 2002/0007825 | A1 * | 1/2002 | Beyer et al. | 123/509 |
| 2003/0188721 | A1 * | 10/2003 | Beyer et al. | 123/509 |
| 2004/0112819 | A1 | 6/2004 | Ebihara et al. | |
| 2005/0053500 | A1 * | 3/2005 | Suzuki et al. | 417/423.15 |
| 2005/0058556 | A1 | 3/2005 | Cremer et al. | |
| 2008/0078918 | A1 | 4/2008 | Fujiwara et al. | |
| 2009/0101117 | A1 | 4/2009 | Osawa | |

FOREIGN PATENT DOCUMENTS

| | | |
|---|---|---|
| EP | 0 903 255 | 1/2004 |
| GB | 2 440 521 | 2/2008 |
| JP | 3-124954 | 5/1991 |
| JP | 2004-353535 | 12/2004 |
| JP | 2008-088814 | 10/2008 |
| JP | 2008-248801 | 10/2008 |

OTHER PUBLICATIONS

U.S. Appl. No. 13/230,049, of Okazono, filed Sep. 12, 2011.
U.S. Appl. No. 13/230,027, of Okazono, filed Sep. 12, 2011.
(Continued)

*Primary Examiner* — Charles Freay
(74) *Attorney, Agent, or Firm* — Nixon & Vanderhye P.C.

(57) ABSTRACT

A reservoir is in a bottomed tubular shape and located in a fuel tank. A lid member closes an opening of the reservoir. A pump unit discharges fuel stored in the reservoir to an exterior of the fuel tank. The pump unit is supported by a holding portion of the lid member.

8 Claims, 19 Drawing Sheets

(56) References Cited

OTHER PUBLICATIONS

U.S. Appl. No. 13/229,995, of Okazono, filed Sep. 12, 2011.

Japanese Office Action issued for Japanese Patent Application No. 2011-110618, dated May 7, 2014 (wtih partial English translation).

* cited by examiner

FUEL FEED APPARATUS

CROSS REFERENCE TO RELATED APPLICATIONS

This application is based on and claims priority to Japanese Patent Applications No. 2010-204623 filed on Sep. 13, 2010, No. 2011-24340 filed on Feb. 7, 2011, and No. 2011-110618 filed on May 17, 2011, the contents of which are incorporated in their entirely herein by reference.

FIELD OF THE INVENTION

The present invention relates to a fuel feed apparatus equipped in a fuel tank of a vehicle for feeding fuel to an exterior of the fuel tank.

BACKGROUND OF THE INVENTION

For example, a known fuel feed apparatus includes a bottomed tubular reservoir located in a fuel tank for storing fuel and a pump unit for discharging stored fuel to an exterior of the fuel tank. JP-A-2008-248801 discloses one example of such a reservoir-type fuel feed apparatus including an annular bracket located in a fuel tank. The annular bracket is mounted to an opening periphery of the reservoir for supporting a pump unit.

When a vehicle equipped with the fuel feed apparatus disclosed in JP-A-2008-248801 is inclined rapidly relative to the horizontal surface, fuel may spill from the opening of the reservoir. Consequently, the reservoir may not be able to secure fuel sufficiently for supplying to the exterior of the fuel tank. It is conceivable to increase the height of the reservoir in order to reduce such spill of fuel from the reservoir. However, when the height of the reservoir is increased, the reservoir may easily wobble due to vibration caused by the pump unit, which is supported by the opening periphery of the reservoir via the bracket, when the pump unit discharges fuel In addition, large stress works in the annular bracket of the fuel feed apparatus disclosed in JP-A-2008-248801, since the annular bracket supports the pump unit. Therefore, it is required that the bracket has a large rigidity. Consequently, vibration of the pump unit is easily transmitted to the reservoir. Such transmission of vibration may increase wobble of the reservoir and is not desirable.

SUMMARY OF THE INVENTION

The present invention is made in view of the foregoing and other problems, and an object of the present invention is to provide a fuel feed apparatus configured to reduce wobble of a reservoir.

According to one aspect of the present invention, a fuel feed apparatus comprises a reservoir being in a bottomed tubular shape and located in a fuel tank. The fuel feed apparatus further comprises a lid member located in the fuel tank and mounted to a periphery of an opening of the reservoir to close the opening. The fuel feed apparatus further comprises a pump unit located in the fuel tank and configured to discharge fuel stored in the reservoir to an exterior of the fuel tank. The pump unit is supported by a holding portion of the lid member.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
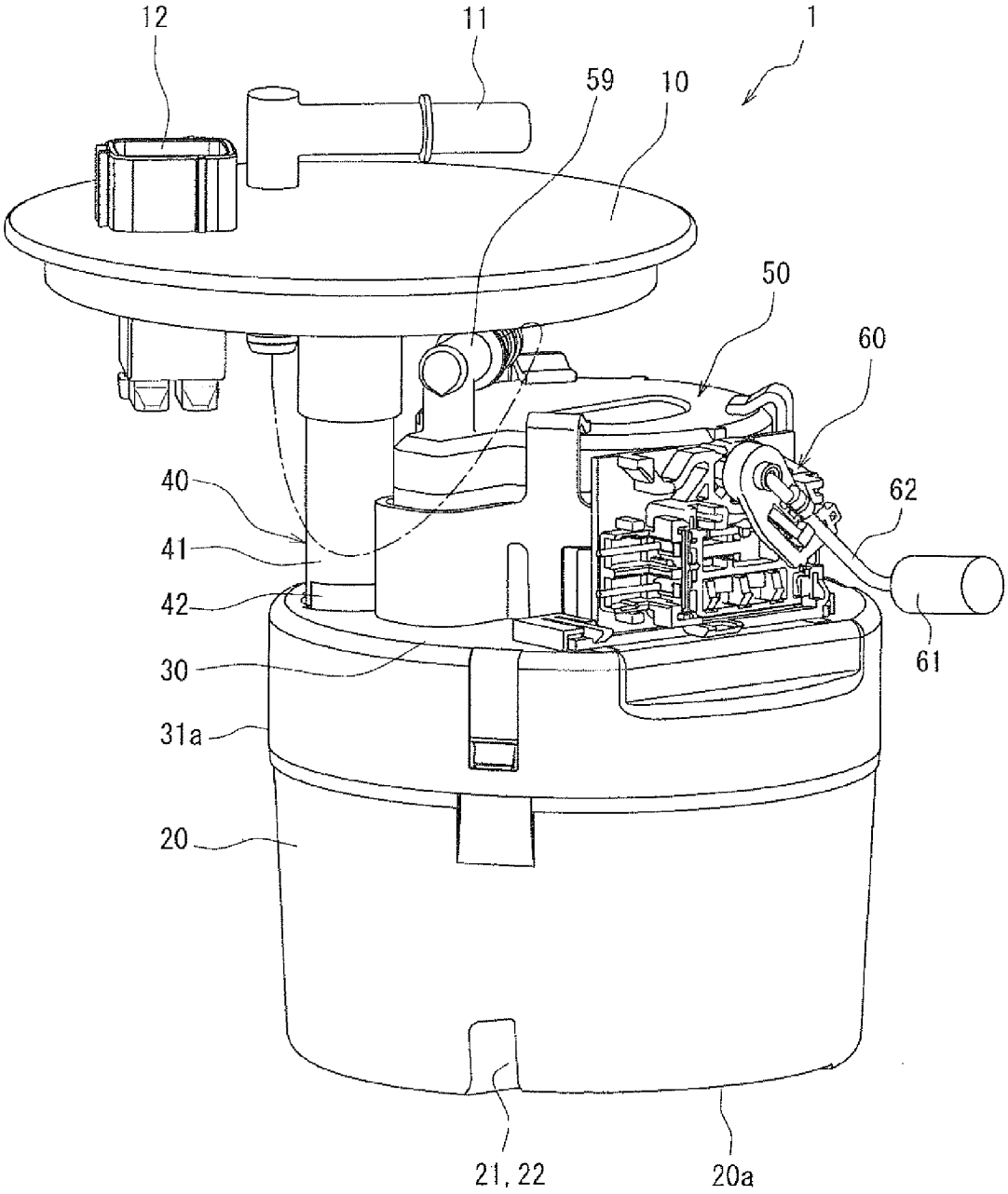
FIG. 1 is a perspective view showing a fuel feed apparatus according to the first embodiment.
Figure 2:
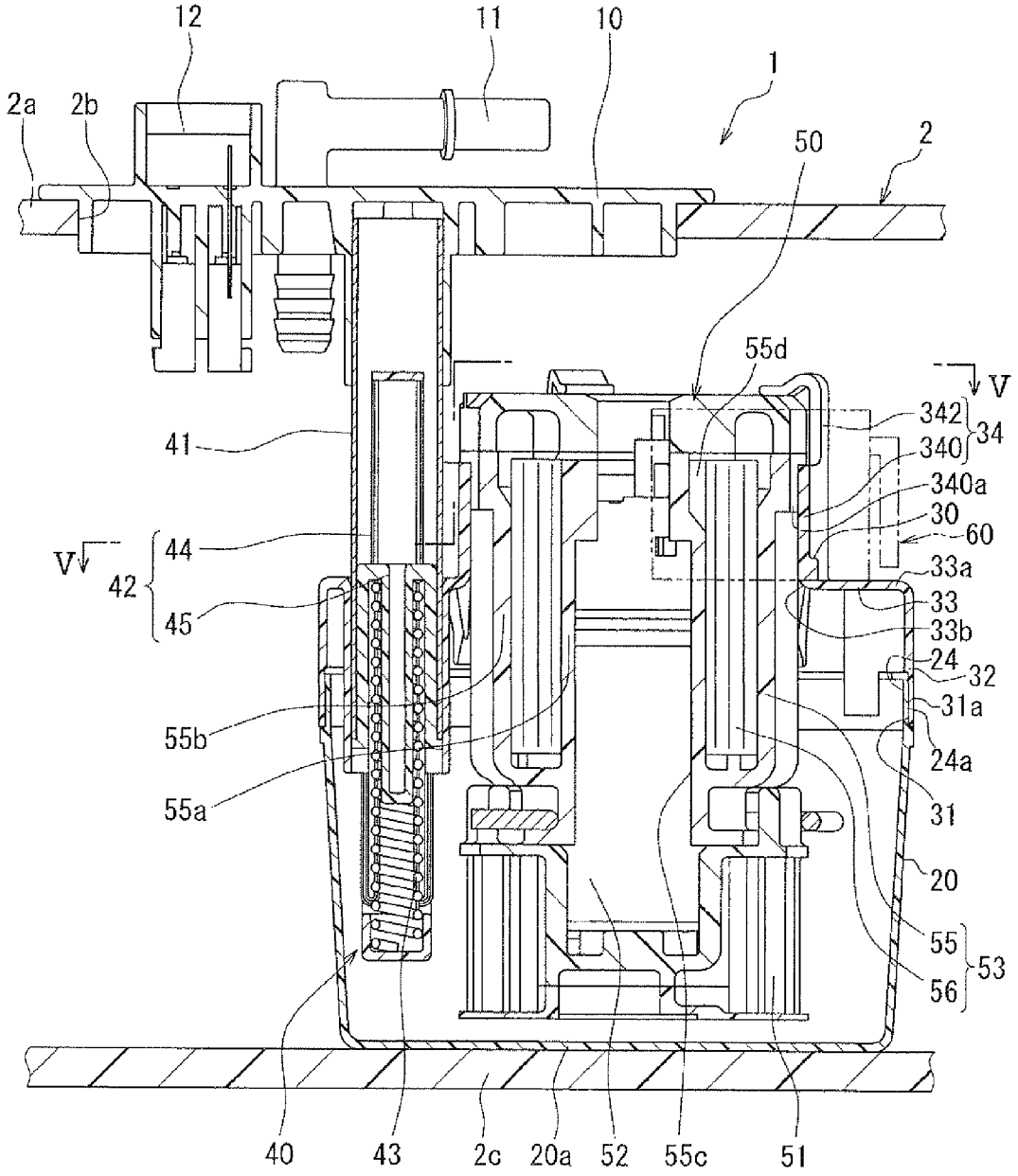
FIG. 2 is a sectional view showing the fuel feed apparatus, the sectional view taken along the line II-II in FIG. 3.

FIGS. 1, 2 show a fuel feed apparatus according to the first embodiment. A fuel feed apparatus 1 is equipped in a fuel tank 2 of a vehicle for feeding fuel to an exterior of the fuel tank 2.

General Configuration

The fuel feed apparatus 1 includes a flange 10, a reservoir 20, a lid member 30, an adjustment device 40, a pump unit 50, and a remaining quantity detector 60. As shown in FIG. 2, components 20, 30, 40, 50, and 60 of the fuel feed apparatus 1 other than the flange 10 are located at a predetermined position inside the fuel tank 2. The vertical direction in FIG. 2 substantially coincides with the vertical direction of the vehicle being on a horizontal surface.

Figure 3:
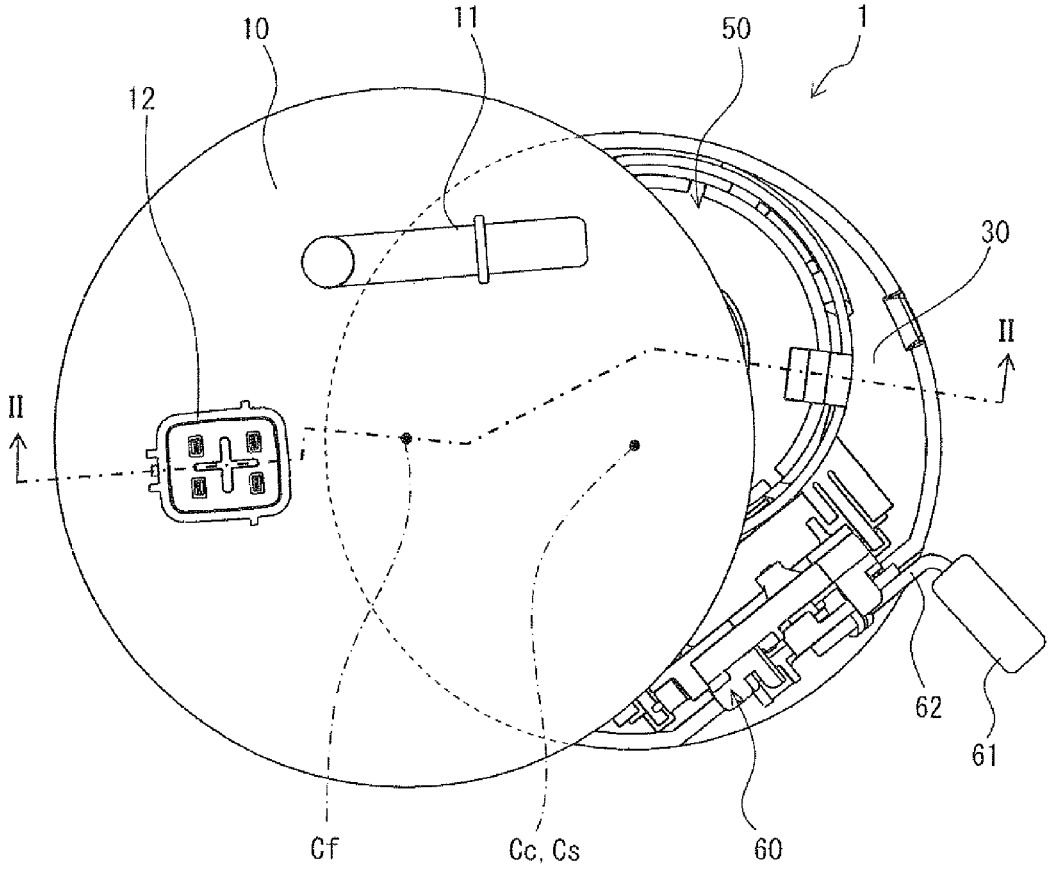
FIG. 3 is a top view showing the fuel feed apparatus.

As shown in FIGS. 1 to 3, the flange 10 in a disc shape is formed of resin. The flange 10 is fitted in a through hole 2*b* to close the through hole 2*b*. The through hole 2*b* extends through a top plate portion 2*a* of the fuel tank 2. A fueling pipe 11 and an electrical connector 12 are provided to the flange 10. The fueling pipe 11 is used for supplying fuel discharged from the pump unit 50 to the exterior of the fuel tank 2. The electrical connector 12 is electrically connected with the pump unit 50 and the remaining quantity detector 60. In the present configuration, a fuel pump 52 of the pump unit 50 is supplied with an electric power through the electrical connector 12, thereby being driven and controlled. In addition, the remaining quantity detector 60 outputs a remaining quantity detection signal through the electrical connector 12.

Figure 4:
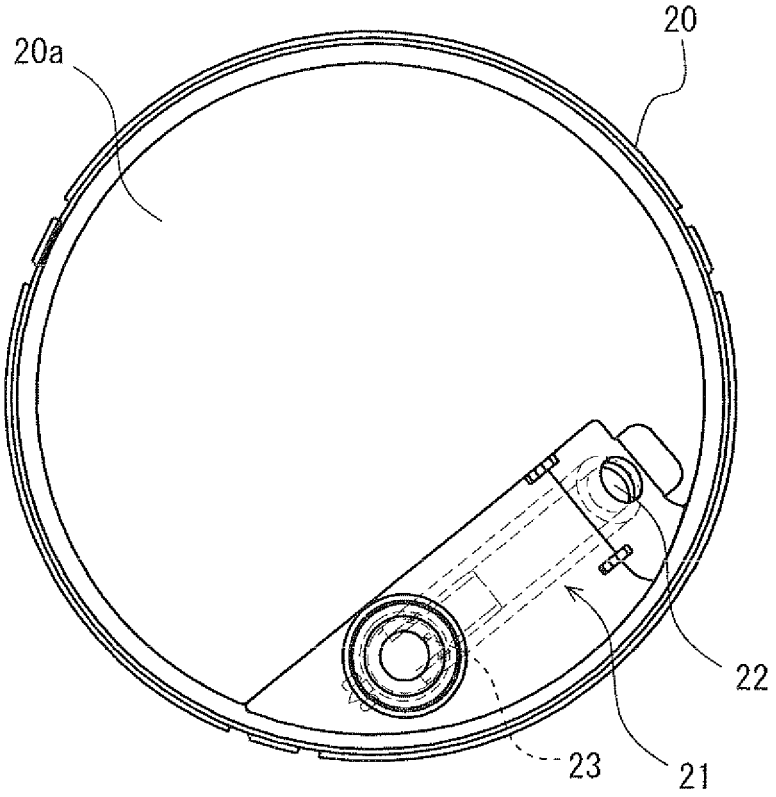
FIG. 4 is a top view showing a reservoir of the fuel feed apparatus.
Figure 5:
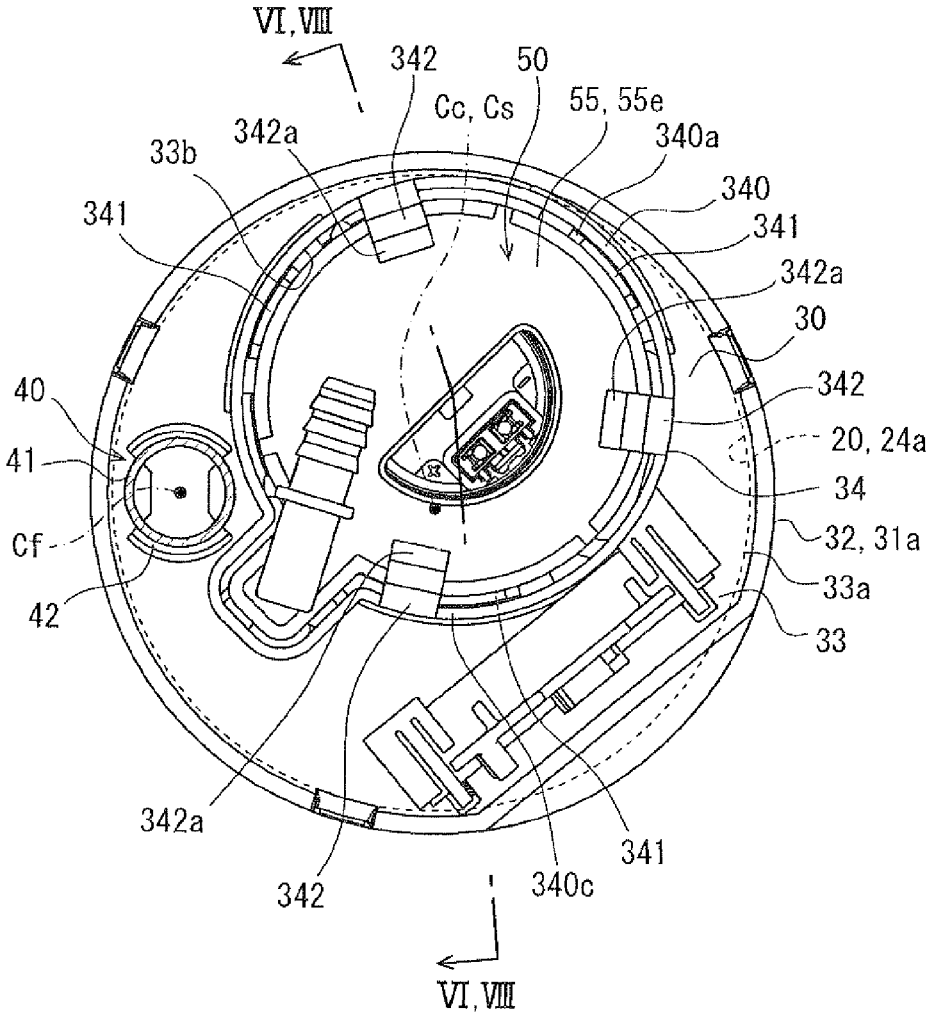
FIG. 5 is a sectional view taken along the line V-V in FIG. 2.
Figure 6:
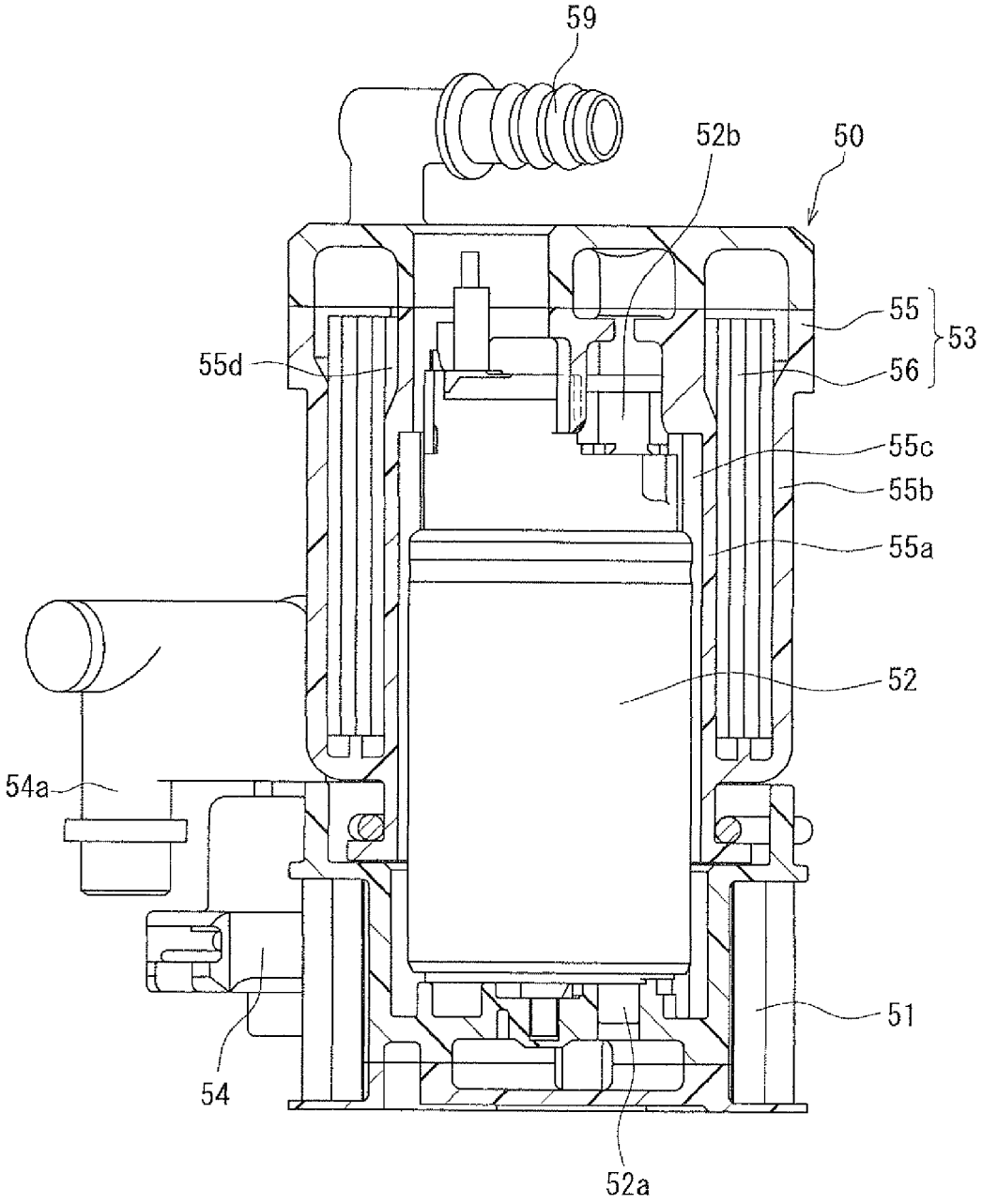
FIG. 6 is a sectional view taken along the line VI-VI in FIG. 5.

As shown in FIGS. 1, 2, the reservoir 20 being in a bottomed tubular shape is formed of resin. The reservoir 20 is accommodated in the fuel tank 2 and located on a bottom portion 2*c* of the fuel tank 2. As shown in FIGS. 3, 5, the reservoir 20 has a center axis Cs being offset from a center axis Cf of the flange 10. As shown in FIGS. 1, 4, a jet pump 21 is provided to a bottom portion 20*a* of the reservoir 20. The jet pump 21 has an introduction passage 22 and a jet nozzle 23. The introduction passage 22 communicates the interior of the fuel tank 2 with the interior of the reservoir 20. As shown in FIG. 6, a pressure regulator 54 of the pump unit 50 exhausts surplus fuel. The jet nozzle 23 jets the exhausted surplus furl into the introduction passage 22. The fuel jet causes a negative pressure in the introduction passage 22. The negative pressure, which is lower than atmospheric pressure, causes the introduction passage 22 to draw fuel from the fuel tank 2 into the reservoir 20. The reservoir 20 stores the fuel drawn in this way.

As shown in FIGS. 1, 2, 5, the lid member 30 formed of resin is in a tubular shape having a ceiling. The lid member 30 has a circumferential periphery 31*a* defining a lower opening 31. The circumferential periphery 31*a* of the lid member 30 is fitted to a circumferential periphery 24*a* of an upper opening 24 of the reservoir 20. The lid member 30 is coaxial with the reservoir 20. As show in FIGS. 3, 5, a center axis Cc of the lid member 30 is offset from (i.e., located at a different position from) the center axis Cf of the flange 10. The lid member 30 blocks the opening 24 of the reservoir 20 accommodated in the fuel tank 2. The lid member 30 holds the pump unit 50 and the remaining quantity detector 60 in the fuel tank 2.

The adjustment device 40 includes a pillar 41, an intermediate member 42, and an elastic member 43. The pillar 41 formed of metal is in a tubular shape. The pillar 41 is press-fitted to the flange 10 to be coaxial with the flange 10. The pillar 41 is integrated with components (integrated components) 20, 30, 50, 60 via the intermediate member 42. In this way, the flange 10 is connected with the integrated components 20, 30, 50, 60 via the pillar 41 being a single component.

As shown in FIG. 2, the intermediate member 42 includes a pair of brackets 44, 45 formed of resin. The brackets 44, 45 are not rotative relative to each other in the circumferential direction of the pillar 41. The brackets 44, 45 are movable relative to each other in the axial direction of the pillar 41. The brackets 44, 45 are mounted to the lid member 30 and the pillar 41. Thereby, the intermediate member 42 constructed of the brackets 44, 45 regulates relative movement between the pillar 41 and the integrated components 20, 30, 50, 60 in the circumferential direction of the pillar 41 while allowing relative movement between the pillar 41 and the integrated components 20, 30, 50, 60 in the axial direction of the pillar 41.

In the present example, the elastic member 43 is a coil spring. The elastic member 43 is interposed between the bracket 45 of the intermediate member 42 and the lid member 30. The bracket 45 is integrated with the pillar 41. The elastic member 43 applies an elastic force in the axial direction of the pillar 41 to bias the integrated components 20, 30, 50, 60 toward the bottom portion 2*c* of the fuel tank 2. Thereby, the elastic member 43 regularly biases the bottom portion 20*a* of the reservoir 20 onto the bottom portion 2*c* of the fuel tank 2. In the present embodiment, the elastic member 43 and the intermediate member 42 function to stabilize the positions of the integrated components 20, 30, 50, 60 in the fuel tank 2.

The pump unit 50 has a lower portion accommodated in the reservoir 20 and an upper portion projecting from the lid member 30. As shown in FIGS. 2, 6, the pump unit 50 includes a suction filter 51, the fuel pump 52, a fuel filter 53, and the pressure regulator 54.

The suction filter 51 is located at the lowermost portion of the pump unit 50. The suction filter 51 is connected with a fuel inlet port 52*a* of the fuel pump 52 for removing large foreign matter contained in fuel drawn by the fuel pump 52 from the reservoir 20. The fuel pump 52 is located on the upper side of the suction filter 51 in the pump unit 50. The fuel inlet port 52*a* extends downward from the fuel pump 52. A fuel outlet port 52*b* extends upward from the fuel pump 52. The fuel pump 52 draws fuel from the reservoir 20 into the fuel inlet port 52*a* through the suction filter 51. The quantity of fuel drawn by the fuel pump 52 corresponds to rotation of a built-in motor (not shown). The fuel pump 52 pressurizes the drawn fuel and discharges the pressurized fuel through the fuel outlet port 52*b*.

The fuel filter 53 is located in the pump unit 50. The fuel filter 53 surrounds the upper portion and the circumferential periphery of the fuel pump 52. A filter case 55 of the fuel filter 53 includes tubular portions 55*a*, 55*b* formed of resin. The tubular portions 55*a*, 55*b* have a two-layer structure including an inner tubular portion 55*a* defining an inner space 55*c* in which the fuel pump 52 is located. The fuel pump 52 is coaxial with the tubular portion 55*a*. A filter element 56 of the fuel filter 53 is, for example, a honeycomb-like filter sheet. The filter element 56 is accommodated in a space 55*d* between the inner tubular portion 55*a* and an outer tubular portion 55*b*. The space 55*d* defined between the tubular portions 55*a*, 55*b* has a fuel upstream side and a fuel downstream side on both sides of the filter element 56. The fuel upstream side and the fuel downstream side respectively communicate with the fuel outlet port 52*b* of the fuel pump 52 and a fuel outlet 59 of the fuel filter 53. In the present structure, fuel flows from the fuel outlet port 52*b* into the space 55*d*, and microscopic foreign matter contained in the flowing fuel is removed through the filter element 56. The fuel is, as shown by the dashed dotted line in FIG. 1, discharged to the fueling pipe 11 connected with the fuel outlet 59.

As shown in FIG. 6, the pressure regulator 54 is adjacent to the side of the fuel filter 53 in the pump unit 50. Fuel is supplied to the fueling pipe 11, and the fuel partially flows into the pressure regulator 54 connected with the fuel outlet 59 of the fuel filter 53. In the present structure, the pressure regulator 54 controls a pressure of the fuel discharged to the fueling pipe 11, which is outside of the fuel tank 2. The pressure regulator 54 generates surplus fuel when regulating the pressure of fuel and discharges the surplus fuel to the jet nozzle 23 (FIG. 4) of the jet pump 21 through an exhaust pipe 54*a*.

As shown in FIGS. 1, 3, the remaining quantity detector 60 is supported on the lid member 30 and located outside of the reservoir 20. In the present example, the remaining quantity detector 60 is a sender gauge including an arm 62 holding a float 61. The float 61 floats in fuel stored in the fuel tank 2. The remaining quantity detector 60 detects a quantity of fuel remaining in the fuel tank 2 according to the rotation angle of the arm 62.

Configuration

Figure 7:
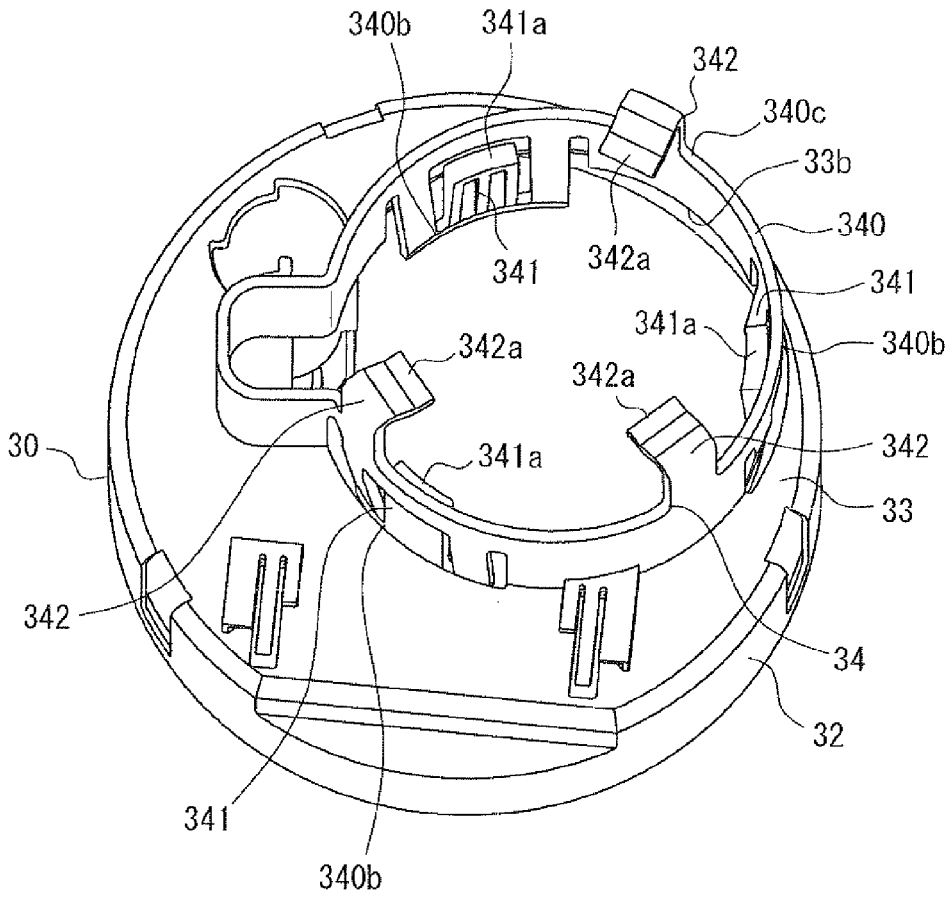
FIG. 7 is a perspective view showing a lid member of the fuel feed apparatus.

As follows, a configuration of the fuel feed apparatus 1 will be described. As shown in FIG. 7, the lid member 30 formed of resin includes a mount portion 32, an annular plate portion 33, and a holding portion 34. As shown in FIGS. 2, 5, the mount portion 32 is in a tubular shape and provided to the lowermost portion of the lid member 30. The mount portion 32 has a circumferential periphery 31*a* defining a lower opening 31. The mount portion 32 is mounted to be coaxial with the circumferential periphery 24*a* defining the upper opening 24 of the reservoir 20. The annular plate portion 33 is in a disc shape and located at an intermediate portion of the lid member 30 in the vertical direction (axial direction). The annular plate portion 33 connects the mount portion 32 with the outer circumferential periphery 33*a* to be in coaxial with each other. The annular plate portion 33 has a through hole 33*b* being in a circular shape. The lid member 30, when being viewed as a total element, has a center axis Cc offset from the through hole 33*b*. The center axis Cc coincides with the center axis of the mount portion 32. As shown in FIGS. 2, 5, 7, the holding portion 34 is provided to the uppermost portion of the lid member 30. The holding portion 34 includes a holding main body 340, an elastic piece (elastic nail) 341, and, and an elastic nail 342 integrally formed with each other.

Figure 8:
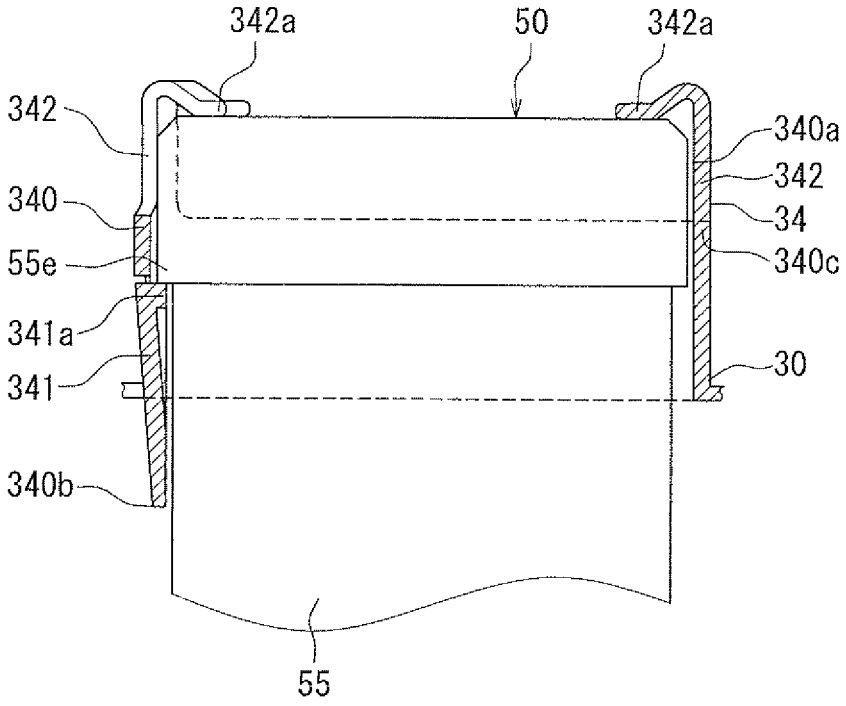
FIG. 8 is a sectional view taken along the line VIII-VIII in FIG. 5 and showing the lid member and a pump unit assembled in the fuel feed apparatus.

Specifically, the holding main body 340 being in a tubular shape is connected to be coaxial with the through hole 33*b*. The annular plate portion 33 has the inner periphery defining the through hole 33*b*. As shown in FIGS. 2, 5, 8, the filter case 55 of the pump unit 50 is inserted to be coaxial with the inner circumferential periphery of the holding main body 340 to define a gap 340*a* therebetween.

As shown in FIGS. 5, 7, 8, each of the elastic pieces 341 is in a rectangle plate shape. The elastic pieces 341 protrude from multiple places (e.g., three locations) of the holding main body 340 radially inward to the filter case 55. The elastic pieces 341 are spaced at regular intervals in the circumferential direction of the holding main body 340. In the present embodiment, each of the elastic pieces 341 is supported by a projected piece 340*b* of the holding main body 340. The projected piece 340*b* is projected downward. In the present structure, each of the elastic pieces 341 is elastically deformable in the radial direction on the side of the outer circumferential periphery of the filter case 55. Each of the elastic pieces 341 has an upper end portion 341*a* supporting the projected portion 55*e* upward from the lower side. The projected portion 55*e* is projected radially outward from the uppermost portion of the filter case 55.

Each of the elastic nails 342 is in an inverted L-shape. The elastic nails 342 are respectively projected from multiple places (e.g., three places) of the holding main body 340. The elastic nails 342 are spaced at regular intervals in the circumferential direction. Each of the elastic nails 342 is projected upward and bent radially inward to the filter case 55. In the present embodiment, each of the elastic nails 342 is shifted relative to corresponding one of the elastic pieces 341 in the circumferential direction of the holding main body 340. The elastic nail 342 is supported by an upper end portion 340*c* of the holding main body 340. In the present structure, each of the elastic nails 342 has a bent-side tip end defining a hook 342*a*. The hook 342*a* is located on the upper side of the filter case 55 and elastically deformable in the axial direction. The hook 342*a* and the upper end portion 341 a of corresponding one of the elastic pieces 341 interpose the projected portion 55*e* of the filter case 55 therebetween.

Figure 9A:
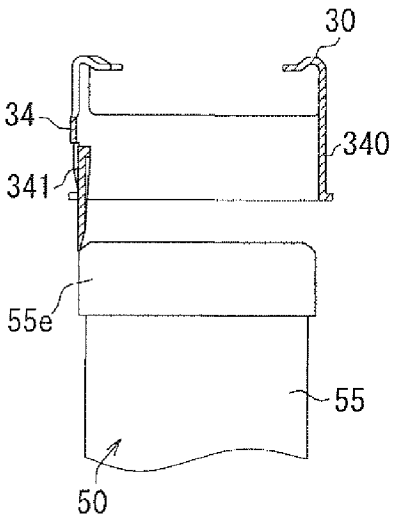
FIGS. 9A to 9D are sequential views showing a procedure for mounting the lid member to the pump unit of the fuel feed apparatus.
Figure 9B:
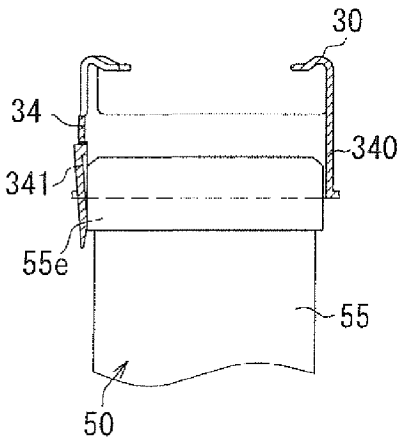
Figure 9C:
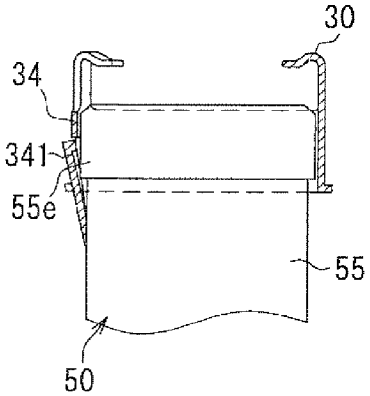
Figure 9D:
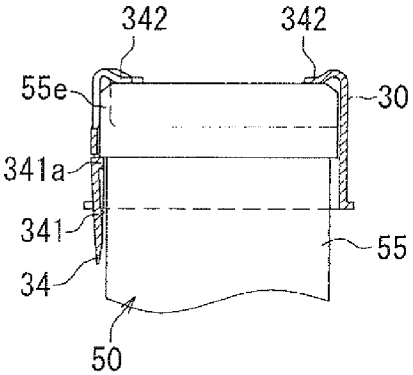

The lid member 30 having the above-noted structure is assembled to the filter case 55 of the pump unit 50. Specifically, as shown in FIGS. 9A, 9B, the holding main body 340 is first aligned with the projected portion 55*e* and mounted to the upper portion of the projected portion 55*e*. In this way, the projected portion 55*e* is inserted into the inner circumferential periphery of the holding main body 340. Before the insertion, as shown in FIG. 9A, each of the elastic pieces 341 is inclined inward as it goes upward in the axial direction of the holding main body 340. That is, the elastic piece 341 is inclined inward most at the upper portion in the axial direction. As shown in FIG. 9B, when the insertion is started, each of the elastic pieces 341 is pressed radially outward by the projected portion 55*e* and elastically deformed. Subsequently, as shown in FIG. 9C, as the insertion proceeds, each of the elastic pieces 341 being elastically deformed reaches to the lower portion of the projected portion 55*e*. Then, as shown in FIG. 9D, each of the elastic pieces 341 is restored to support the projected portion 55*e* at the upper end portion 341*a* from the lower side. Thus, the elastic piece 341 and the elastic nail 342 interpose the projected portion 55*e* therebetween. As shown in FIG. 2, the lid member 30 in the present state is equipped to the reservoir 20. In the present configuration, the pump unit 50 is supported by the holding portion 34 such that the suction filter 51 being the lowermost portion of the pump unit 50 is floated to be spaced from the bottom portion 20*a* of the reservoir 20.

In the fuel feed apparatus 1 described above, the circumferential periphery 24*a* of the opening 24 of the reservoir 20 is located in the fuel tank 2. The mount portion 32 of the lid member 30 is attached to the circumferential periphery 24*a* of the opening 24 of the reservoir 20 thereby to close the opening 24. Thereby, the lid member 30 prohibits spill of fuel from the reservoir 20 even when the vehicle inclines rapidly relative to the horizontal level. The pump unit 50 supported by the holding portion 34 of the lid member 30 may cause vibration when discharging fuel through the lid member 30. The vibration of the pump unit 50 may be transmitted to the reservoir 20 through the lid member 30. In the above-noted structure, such transmission of vibration can be restricted by reducing the height of the reservoir 20 in the vertical direction as much as possible.

In the fuel feed apparatus 1, the annular plate portion 33 of the lid member 30 connects the holding portion 34 with the mount portion 32 to be in an annular arrangement. The annular plate portion 33 is formed to have a wide area. In the above-noted structure, the holding portion 34 is caused to support the pump unit 50 thereby to reduce stress working in the section of the annular plate portion 33. In the present structure, the rigidity of at least the annular plate portion 33 may be reduced in the lid member 30 so as to attenuate vibration transmitted from the pump unit 50 to the reservoir 20 through the annular plate portion 33.

Further, in the above-noted fuel feed apparatus 1, the holding portion 34 of the lid member 30 enables floating support of the pump unit 50 such that the lowermost portion of the pump unit 50 is spaced out from the bottom portion 20*a* of the reservoir 20. In this way, it is possible to restrict wobble of the reservoir 20 caused by transmission of vibration directly from the pump unit 50.

Furthermore, in the fuel feed apparatus 1, the holding portion 34 of the upper end portion 341 a of each of the elastic pieces 341 supports the pump unit 50 from the lower side. Therefore, elastic deformation caused in the elastic pieces 341 enables attenuation of vibration transmitted from the pump unit 50 to the upper end portion 341*a*. In addition, the pump unit 50 is in contact with each of the elastic pieces 341 to cause elastic deformation in the elastic pieces 341. Thereby, the elastic pieces 341 enable attenuation of vibration in the radial direction caused in the pump unit 50 as a vibration source. In the present structure, wobble caused in the reservoir 20 due to vibration transmitted from the pump unit 50 can be further effectively reduced.

In addition, in the fuel feed apparatus 1, the holding portion 34 holds the projected portion 55*e*, which is projected radially outward from the uppermost portion of the pump unit 50, at the upper end portion 341*a* of each of the elastic pieces 341 from the lower side. In the present structure, the position of the barycenter of the pump unit 50 can be set downward relative to the position of the projected portion 55*e* supported by each of the elastic pieces 341. The configuration of the barycenter position being set downward results in reduction in vibration caused in the pump unit 50. Therefore, wobble of the reservoir 20 due to vibration transmitted from the pump unit 50 can be effectively reduced.

Furthermore, in the fuel feed apparatus 1, the projected portion 55*e* of the pump unit 50 is interposed between the elastic piece 341 and the elastic nail 342 in each of the holding portion 34. Therefore, elastic deformation caused in the elastic components 341, 342 effectively attenuate vibration caused in the pump unit 50. In the present structure, wobble caused in the reservoir 20 due to vibration transmitted from the pump unit 50 can be also reduced.

In the above-noted structure of the fuel feed apparatus 1, the holding main body 340 is coaxial with the filter case 55 of the pump unit 50 and located on the radially outside of the filter case 55. The multiple elastic pieces 341 are arranged in the circumferential direction of the holding main body 340 and spaced from each other at regular intervals. The elastic pieces 341 are located on the lateral side of the filter case 55. The elastic pieces 341 arranged in the circumferential direction in this way cause elastic deformation to apply resilience onto the pump unit 50 to pushback the center of the pump unit 50. Thereby, the elastic pieces 341 center the position of the pump unit 50. In the fuel feed apparatus 1, the projected portion 55*e* of the pump unit 50 is interposed between the elastic components 341, 342. Thereby, the pump unit 50 is also positioned in the vertical direction (axial direction),

Second Embodiment

Figure 10:
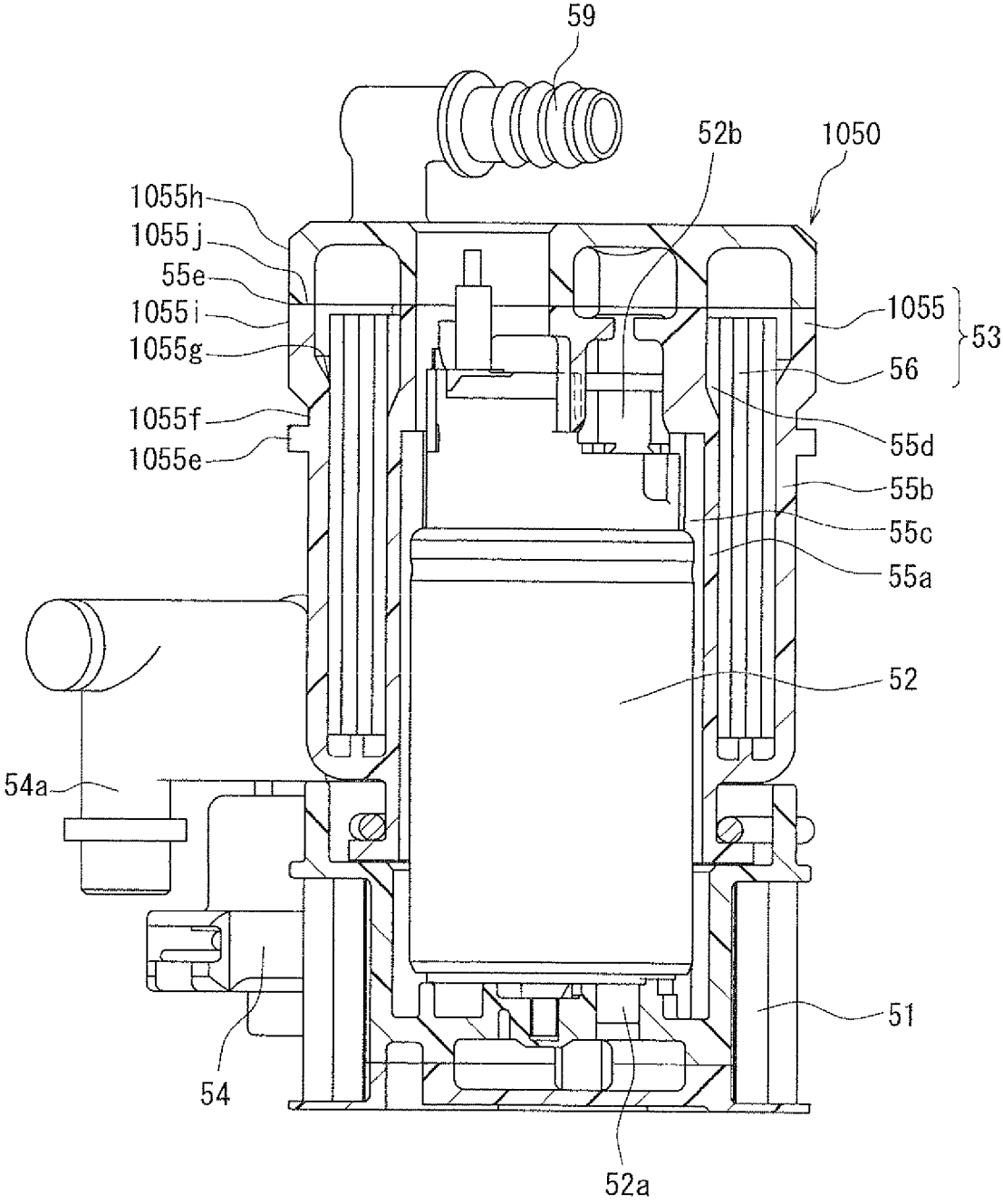
FIG. 10 is a sectional view showing a pump unit of a fuel feed apparatus according to the second embodiment, the drawing corresponding to FIG. 6.

The second embodiment being a modification of the first embodiment will be described with reference to FIGS. 10 to 13. As shown in FIG. 10, according to the second embodiment, two projected portions 55*e*-1055*e* are provided to an upper portion of a filter case 1055 of a pump unit 1050. The two projected portions 55*e*-1055*e* have substantially the same diameter. A groove 1055*f* is interposed between the projected portions 55*e*-1055*e*. Similarly to the first embodiment shown in FIG. 6, the projected portion 55*e* being an uppermost portion of the filter case 1055 is located on the lateral side (radially outside) of a joined portion 1055*g* joined (e.g., welded) with the filter element 56 included in the case 1055. Similarly to the first embodiment shown in FIG. 6, the filter case 1055 is constructed by joining (e.g., welding) two components 1055*h*, 1055*i* above and below. The two components 1055*h*, 1055*i* define a joint interface 1055*j* therebetween in the projected portion 55*e*. In the present structure of the filter case 1055, a projected portion 1055*e* arranged on the lower side of the projected portion 55*e* is offset downward relative to both the lateral side (radially outside) of the joined portion 1055*g* joined with the included component 56 and the joint interface 1055*j* between the two-components 1055*h*, 1055*i*.

Figure 11:
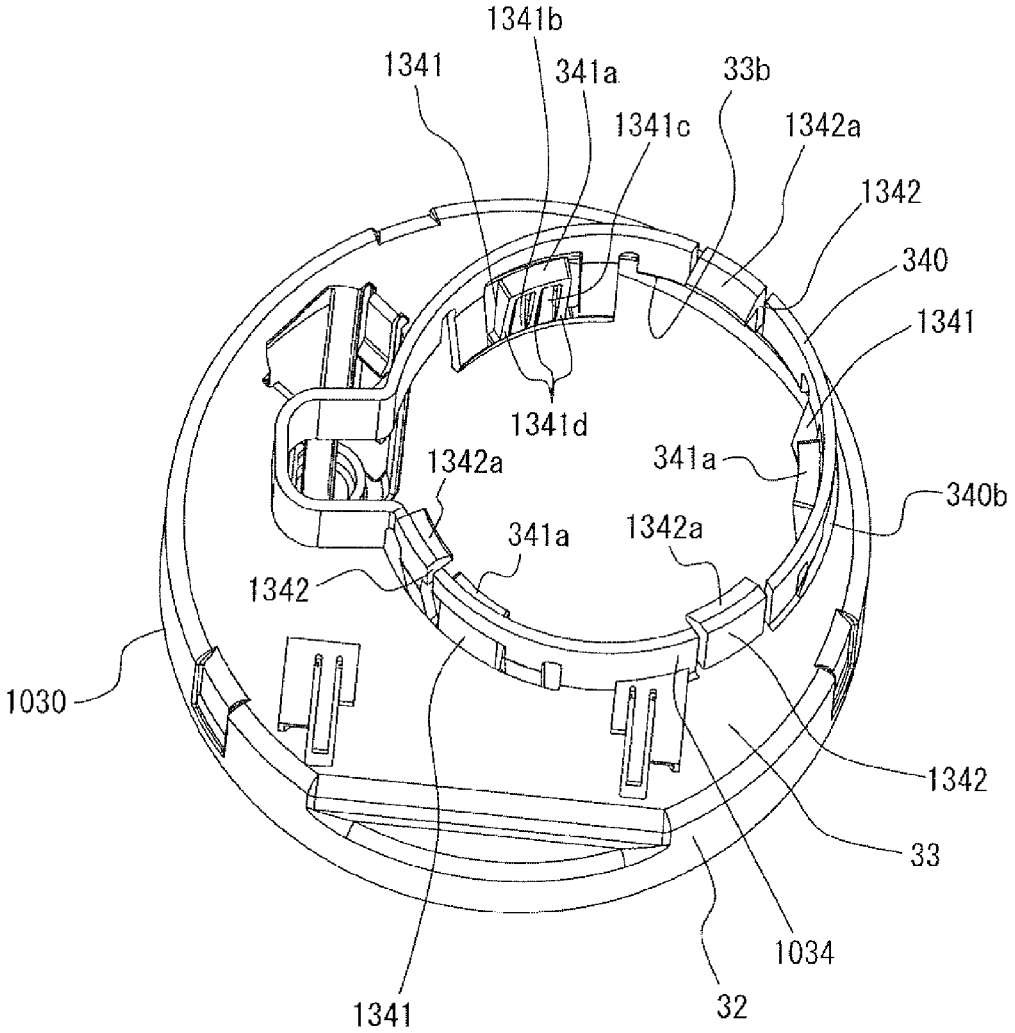
FIG. 11 is a perspective view showing a lid member of the fuel feed apparatus according to the second embodiment, the drawing corresponding to FIG. 7.
Figure 12:
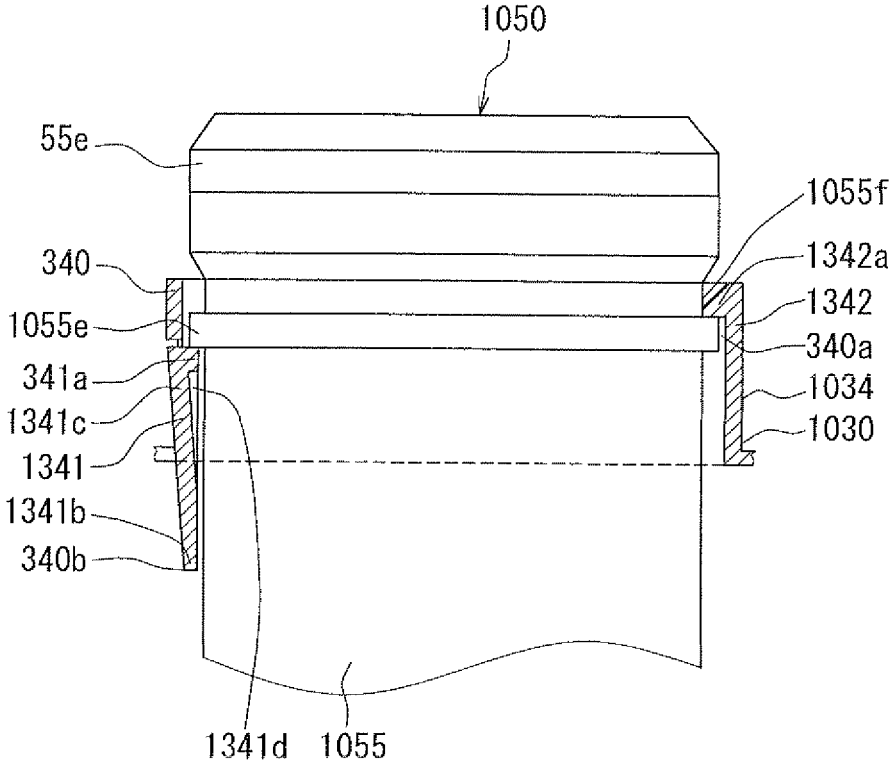
FIG. 12 is a sectional view showing the lid member and a pump unit assembled in the fuel feed apparatus according to the second embodiment, the drawing corresponding to FIG. 8.

As shown in FIGS. 11, 12, the holding portion 1034 of the lid member 1030 according to the second embodiment includes multiple elastic pieces 1341 and multiple elastic nails 1342 arranged at multiple places of the holding main body 340 in the circumferential direction. Each of the elastic pieces 1341 has a structure similar to that of the elastic piece 341 shown in FIGS. 7, 8 according to the first embodiment, excluding the structure supporting the projected portion 1055*e*, instead of supporting the projected portion 55*e*, from the lower side. The elastic piece 1341 has a structure similar to that of the elastic piece 341. The elastic piece 1341 includes a piece body 1341*c* and multiple ribs 1341*d*. The piece body 1341*c* includes an upper end portion 341*a* and a lower end 1341*b*. The upper end portion 341 a projects radially inward. The lower end 1341*b* is connected to the projected piece 340*b*. Each of the ribs 1341*d* is located between the ends 341*a*, 1341*b* and projected radially inward from the main body 1341*c*.

The elastic nails 1342 are located at multiple places distant from each other in the circumferential direction and shifted from corresponding one of the elastic pieces 1341. Each of the elastic nails 1342 is partially separated from the holding main body 340. Each of the elastic nails 1342 has a hook 1342*a* at the upper end portion. The hook 1342*a* projects radially inward to the filter case 1055. In the present structure, each of the elastic nails 1342 is elastically deformable in the radial direction. In addition, the hook 1342*a* of each of the elastic nails 1342 interposes the projected portion 1055*e* located on the lower side with the upper end portion 341 a of the corresponding elastic piece 1341.

Figure 13A:
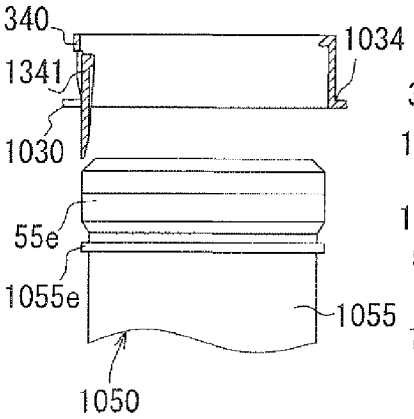
FIGS. 13A to 13D are sequential views showing a procedure for mounting the lid member to the pump unit of the fuel feed apparatus according to the second embodiment.
Figure 13B:
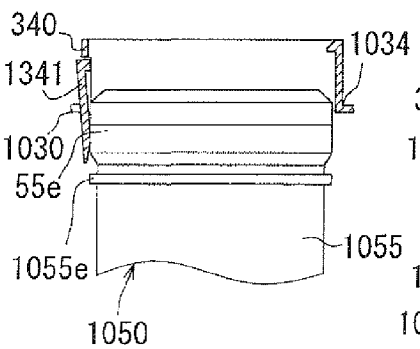

FIGS. 13A to 13D show an example of the lid member 1030 having the above-described structure mounted to the filter case 1055 of the pump unit 1050. As shown in FIGS. 13A, 13B, the holding main body 340 is first positioned relative to the projected portion 55*e* being the uppermost portion and placed to cover the projected portion 55*e* from the upper side. Thereby, the projected portion 55*e* is inserted into the radially inner side of the holding main body 340. Before the insertion, as shown in FIG. 13A, each of the elastic pieces 1341 is inclined inward as it goes upward in the axial direction of the holding main body 340. That is, the elastic piece 341 is inclined inward most at the upper portion in the axial direction. As shown in FIG. 13B, when the insertion is started, each of the elastic pieces 1341 is pressed radially outward by the projected portion 55*e* and elastically deformed.

Figure 13C:
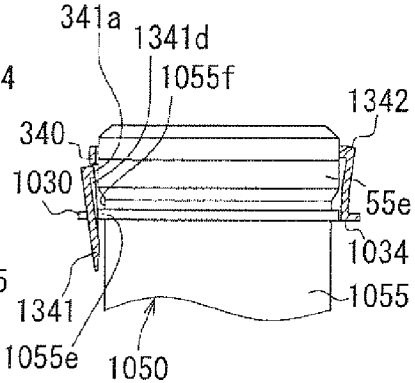

As shown in FIG. 13C, as the insertion is carried out, each of the elastic pieces 1341 is further pressed radially outward by the projected portion 1055*e* from the lower side and further elastically deformed. At this time, the rib 1341*d* projected radially inward from each of the elastic pieces 1341 slides on the lateral side (outermost periphery) of the projected portion 1055*e*. Thereby, the upper end portion 341*a*, which projects radially inward, can be restricted from moving into the groove 1055*f* and from undesirably latching the projected portion 1055*e* from the upper side. In the present state, each of the elastic nails 1342 is pressed by the lateral side of the upper projected portion 55*e* and elastically deformed.

Figure 13D:
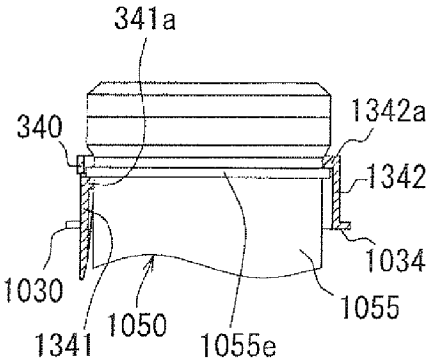

Subsequently, the insertion is further carried out, and each of the elastic pieces 1341, which is being elastically deformed, reaches the lower position of the projected portion 1055*e*. Thus, as shown in FIG. 13D, each of the elastic pieces 1341 and each of the elastic nails 1342 are restored in shape. Consequently, the upper end portion 341*a* of each of the elastic pieces 1341 supports the projected portion 1055*e* from the lower side and interposes the projected portion 1055*e* with the hook 1342*a* of each of the elastic nails 1342. In the present state, the lid member 1030 is equipped to the reservoir 20. Similarly to the first embodiment, the pump unit 1050 is supported by the holding portion 1034 such that the suction filter 51 being the lowermost portion of the pump unit 1050 is floated at a position to be away from the bottom portion 20*a* of the reservoir 20.

In the second embodiment, the filter case 1055 of the pump unit 1050 includes the projected portion 1055*e*. The projected portion 1055*e* is formed to be away (offset) from the lateral side of the joined portion 1055*g*, which is joined with the included component 56. The projected portion 1055*e* is supported by each of the elastic pieces 1341 of the holding portion 1034. When the case 1055 is joined with the included component 56 by, for example, welding, the case 1055 may be deformed due to, for example, welding heat. In the present structure, even when the case 1055 is deformed, each of the elastic pieces 1341 can securely support the projected portion 1055*e*. Thus, transmission of vibration of the pump unit 1050 to the lateral side can be steadily restricted. In addition, the pump unit 1050 can be steadily centered.

In addition, both the projected portion 1055*e* supported by each of the elastic pieces 1341 and the projected portion 55*e* located on the lateral side of the joined portion 1055*g* are provided in the upper portion of the pump unit 1050. Therefore, the barycenter position of the pump unit 1050 can be located downward thereby to reduce vibration. Further, each of the elastic pieces 1341 and each of the elastic nails 1342 of the holding portion 1034 interpose the projected portion 1055*e* therebetween to support the projected portion 1055*e*. In the present structure, elastic deformation of the elastic components 1341 to 1342 enables damping of vibration and positioning of the projected portion 1055*e*. In the present second embodiment, the filter case 1055 includes the two-components 1055*h*, 1055*i* defining the joint interface 1055*j* therebetween. The projected portion 1055*e* is formed to be away from the joint interface 1055*j* in the axial direction and interposed between each of the elastic pieces 1341 and each of the elastic nails 1342. In the present structure, even if the case 1055 is deformed due to, such as, welding heat caused when the two-components 1055*h*, 1055*i* are joined together, the projected portion 1055*e* can be steadily supported. Thus, vibration dumping and positioning of the components can be effectively enabled.

In the present structure of the second embodiment, wobble caused in the reservoir 20 due to vibration transmitted from the pump unit 1050 can be also reduced. Counter force may be caused from each of the elastic pieces 1341 radially inward to the projected portion 1055*e* of the case 1055 when supporting the projected portion 1055*e*. In the second embodiment, even if such counter force is caused, the counter force works on the projected portion 1055*e* away from the joined portion 1055*g* in the axial direction. That is, the counter force does not work directly on the lateral side of the joined portion 1055*g*. Therefore, the counter force works not to squash the joined portion 1055*g*. Thus, durability of the joined portion 1055*g* can be enhanced.

Third Embodiment

Figure 14:
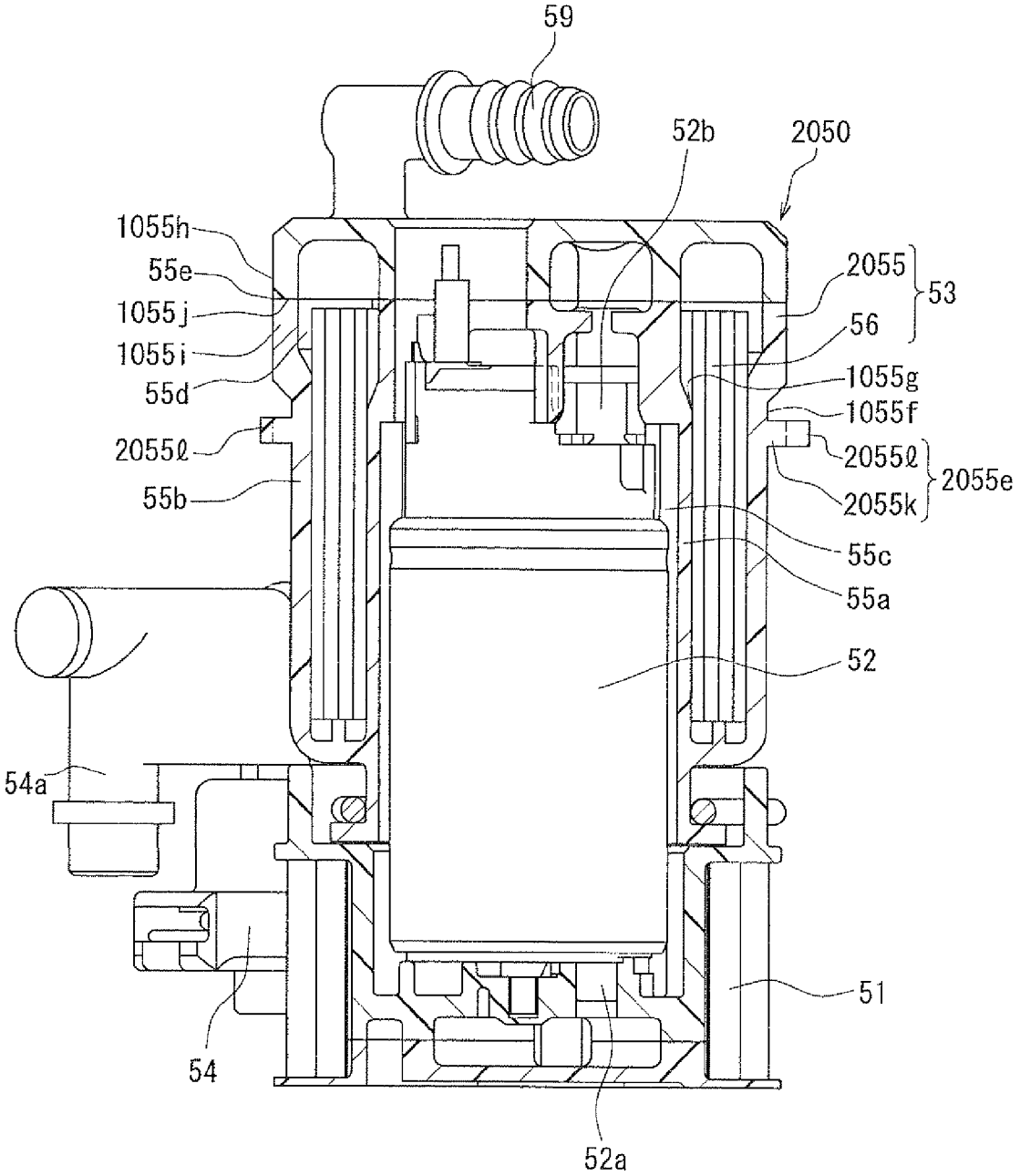
FIG. 14 is a sectional view showing a pump unit of a fuel feed apparatus according to the third embodiment, the drawing corresponding to FIG. 6.

The third embodiment being a modification of the second embodiment will be described with reference to FIGS. 14 to 17. As shown in FIG. 14, according to the third embodiment, a projected portion 2055*e* is provided to an upper portion of a filter case 2055 of a pump unit 2050. The projected portion 2055*e* is arranged on the lower side of the projected portion 55*e*. The projected portion 2055*e* includes a projected portion main body (projected-side tip end) 2055*k* and a projection (projection element) 20551. The projected portion main body 2055*k* has a similar structure as that of the projected portion 1055*e* of the second embodiment and interposes the groove 1055*f* with the projected portion 55*e*. The projection 20551 (projection element) projects further radially outward from a projected-side tip end on the lateral side (projection side) of the main body 2055*k*. In the present structure, the projected portion 2055*e* is also away downward from both the lateral side (radially outer side) of the joined portion 1055*g*, at which the filter case 2055 is joined with the included component 56, and the joint interface 1055*j* between the two-components 1055*h*, 1055*i*. In the third embodiment, multiple projections 20551 are provided respectively at multiple places of the filter case 2055 in the circumferential direction.

Figure 15:
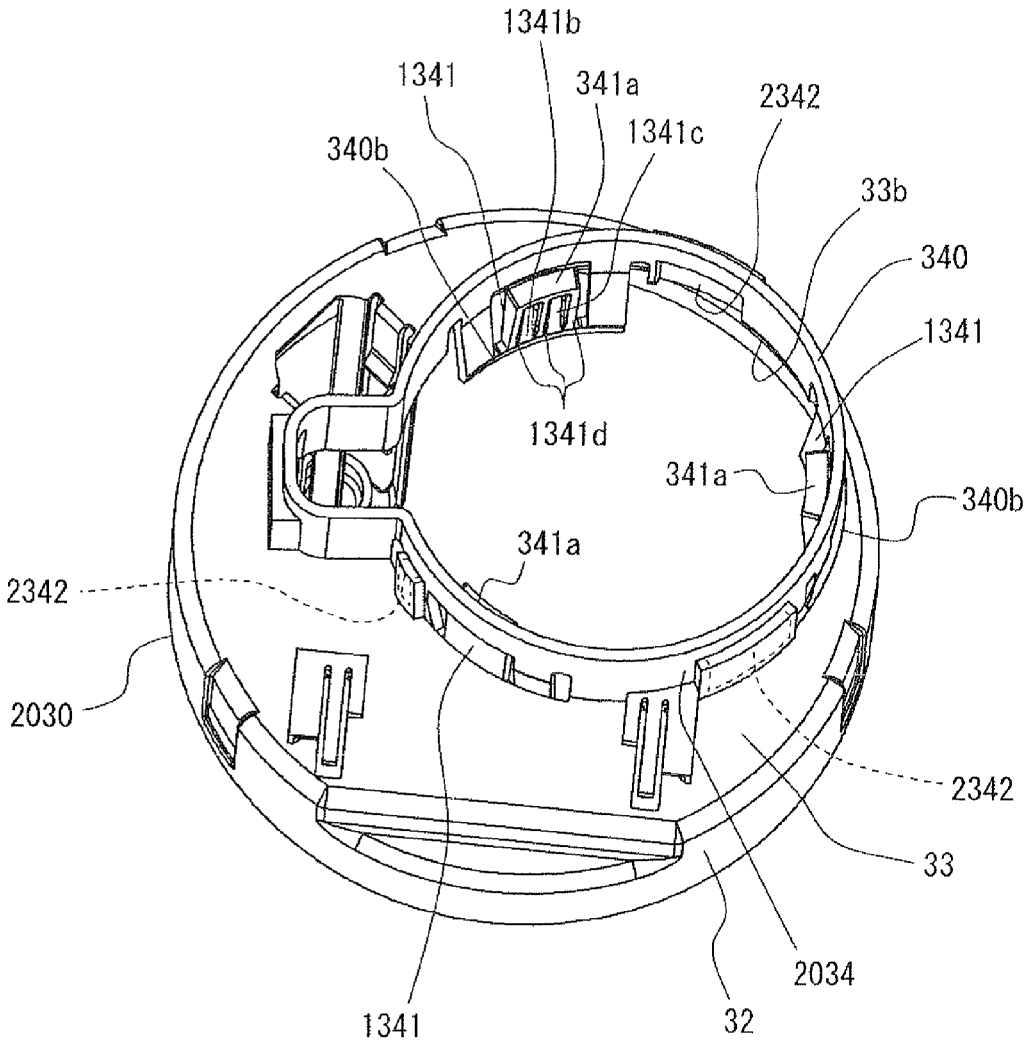
FIG. 15 is a perspective view showing a lid member of the fuel feed apparatus according to the third embodiment, the drawing corresponding to FIG. 7.
Figure 16:
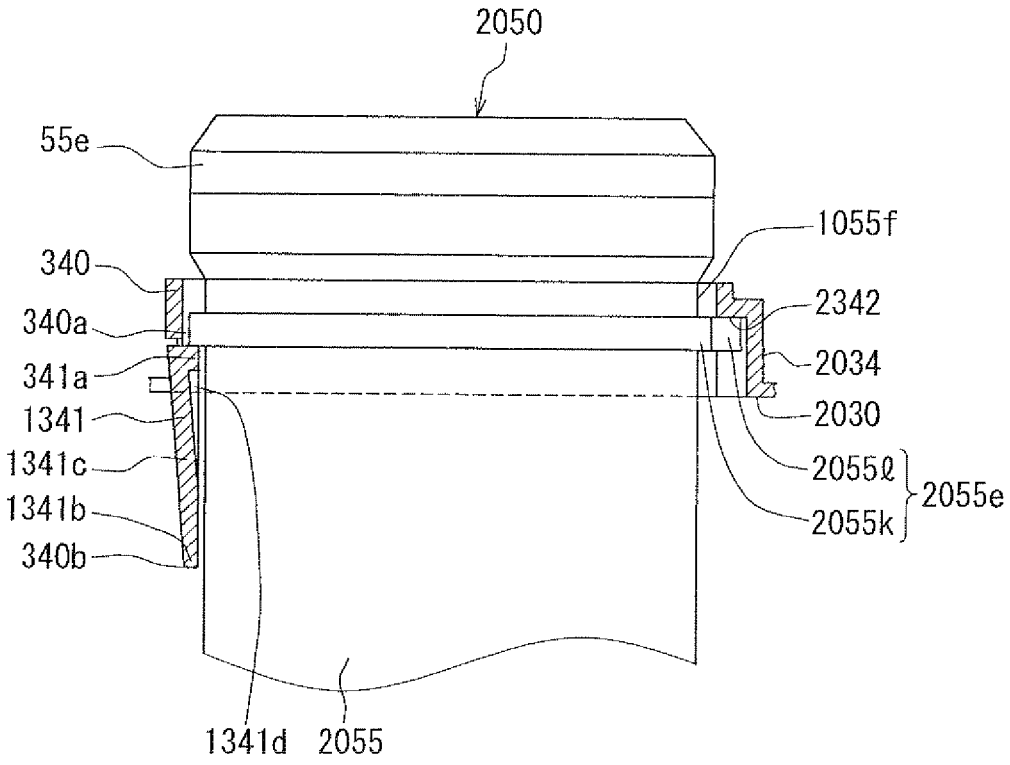
FIG. 16 is a sectional view showing the lid member and a pump unit assembled in the fuel feed apparatus according to the third embodiment, the drawing corresponding to FIG. 8.

As shown in FIGS. 15, 16, a holding portion 2034 of a lid member 2030 according to the third embodiment has multiple fitting recesses 2342 arranged at multiple places of the holding main body 340 in the circumferential direction. Each of the fitting recesses (fitting element) 2342 is shifted from corresponding one of the elastic pieces 1341 in the circumferential direction of the holding main body 340 and dented radially outward to the opposite side of the filter case 2055. In the present structure, each of the fitting recesses 2342 on the upper side is fitted with corresponding one of the projections 20551 of the projected portion 2055*e*. Thereby, the projected portion main body 2055*k* of the projected portion 2055*e* is interposed between the fitting recess 2342 and the upper end portion 341*a* of corresponding one of the elastic pieces 1341.

Figure 17A:
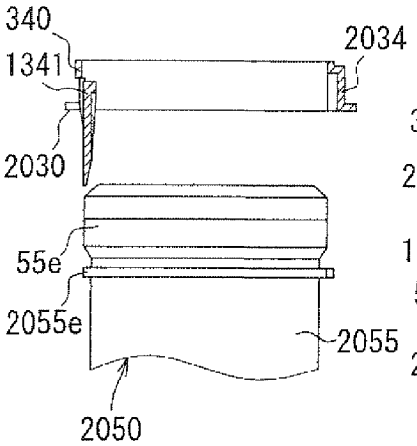
FIGS. 17A to 17D are sequential views showing a procedure for mounting the lid member to the pump unit of the fuel feed apparatus according to the third embodiment.
Figure 17B:
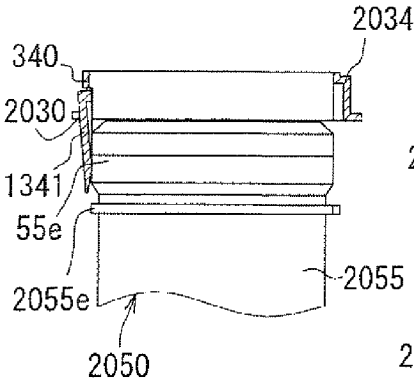

FIGS. 17A to 17D show an example of the lid member 2030 having the above-described structure mounted to the filter case 2055 of the pump unit 2050. As shown in FIG. 17A, each of the elastic pieces 1341 is inclined radially inward before the holding main body 340 is inserted. As shown in FIGS. 17A, 17B, the holding main body 340 is first positioned relative to the projected portion 55*e* being the uppermost portion from the upper side. Simultaneously, the projected portion 55*e* is caused to press the elastic pieces 1341 to elastically deform each of the elastic pieces 1341 radially outward.

Figure 17C:
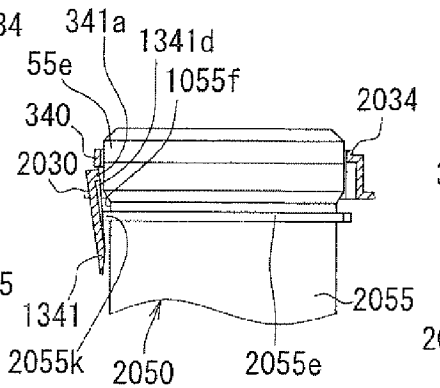

Subsequently, as shown in FIG. 17C, the holding main body 340 is placed to cover the projected portion 55*e* from the upper side. Thereby, the projected portion 55*e* is inserted into the radially inner side of the holding main body 340. In the present state, each of the elastic pieces 1341 is pressed by the lateral side of the projected portion main body 2055*k* of the projected portion 2055*e* from the lower side and elastically deformed. At this time, the rib 1341*d* projected radially inward from each of the elastic pieces 1341 slides on the lateral side (outermost periphery) of the projected portion main body 2055*k*. Thereby, the upper end portion 341*a*, which projects radially inward, can be restricted from moving into the groove 1055*f* and from undesirably latching the projected portion main body 2055*k* from the upper side.

Figure 17D:
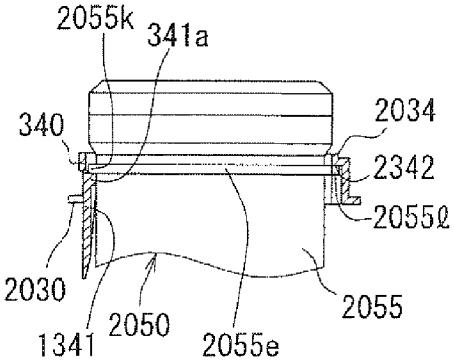

Subsequently, the insertion is further carried out, and each of the elastic pieces 1341, which is being elastically deformed, reaches the lower position of the projected portion main body 2055*k*. Thus, as shown in FIG. 17D, each of the elastic pieces 1341 is restored in shape. In addition, each of the fitting recesses 2342 is fitted to the projection 20551 of each of the projected portions 2055*e* from the upper side. Consequently, the upper end portion 341*a* of each of the elastic pieces 1341 supports the projected portion 2055*e* from the lower side and interposes the projected portion 2055*e* with each of the fitting recess 2342. In the present state, the lid member 2030 is equipped to the reservoir 20. Thus, the pump unit 2050 is supported by the holding portion 2034 such that the suction filter 51 being the lowermost portion of the pump unit 2050 is floated at a position to be away from the bottom portion 20*a* of the reservoir 20.

In the present third embodiment, each of the elastic pieces 1341 and each of the fitting recesses 2342 of the holding portion 2034 interpose the projected portion 2055*e* therebetween. In the present structure, elastic deformation of the elastic component 1341 enables damping of vibration and positioning of the supported component. In addition, the projected portion 2055*e* is formed in the upper portion of the pump unit 2050 and supported by each of the elastic pieces 1341. The projected portion 2055*e* is away (offset) from both the lateral side of the joined portion 1055*g* at which the filter case 2055 is joined with the included component 56 and the joint interface 1055*j* between the two-components 1055*h*, 1055*i*. Therefore, similarly to the second embodiment, transmission of vibration from the pump unit 2050 can be reduced, and the pump unit 2050 can be centered. In addition, the barycenter position of the pump unit 2050 can be lowered to reduce vibration. Thus, reduction in vibration and positioning of components can be enhanced.

In the present structure of the third embodiment, wobble caused in the reservoir 20 due to vibration transmitted from the pump unit 2050 can be also further reduced. Counter force may be caused from each of the elastic pieces 1341 radially inward to the pump unit 2050 when supporting the pump unit 2050. In the third embodiment, even if such counter force is caused, the counter force hardly works on the joined portion 1055*g* away from the projected portion 1055*e* in the axial direction. That is, the counter force does not work directly on the lateral side of the joined portion 1055*g*. Thus, durability of the joined portion 1055*g* can be enhanced.

Fourth Embodiment

Figure 18:
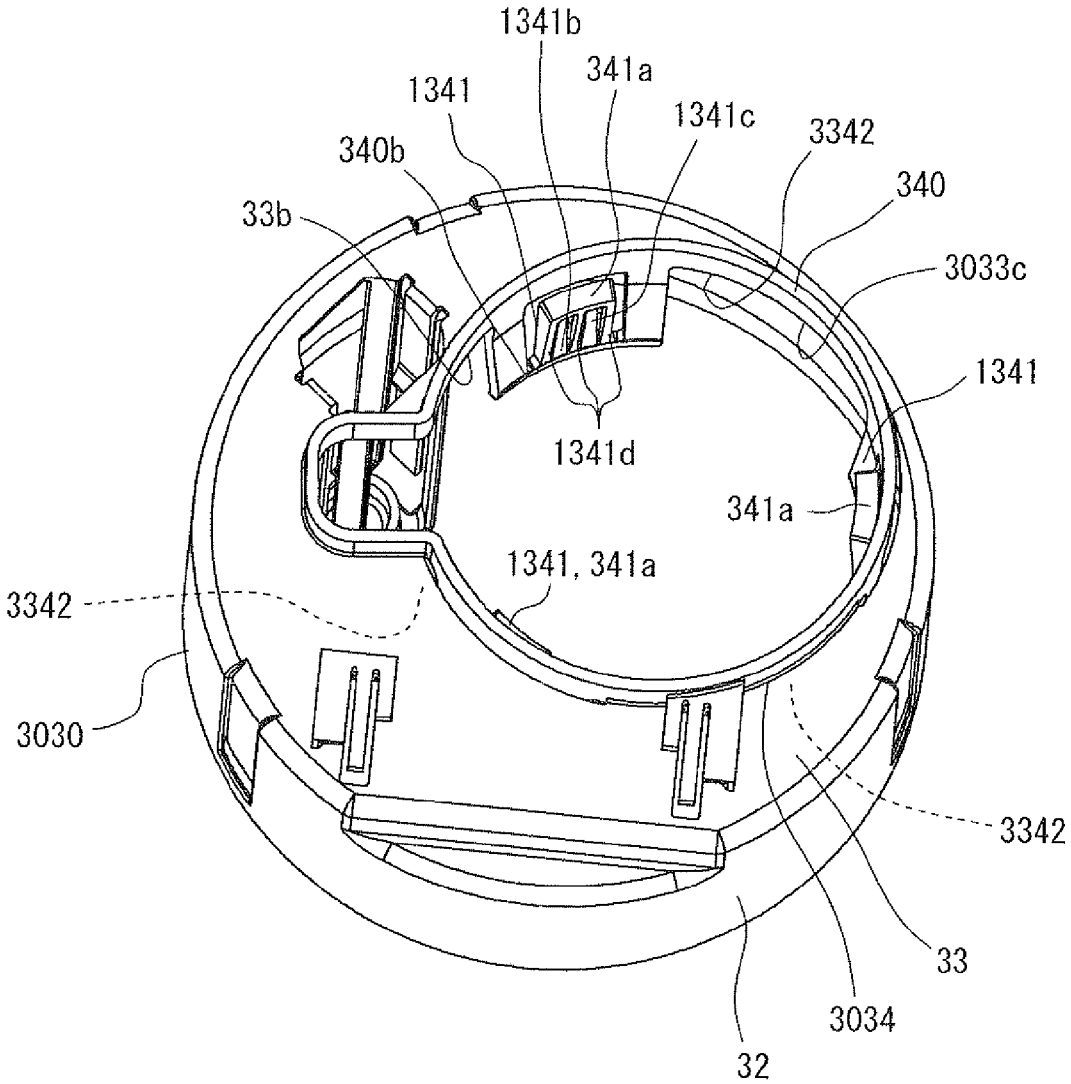
FIG. 18 is a perspective view showing a lid member of a fuel feed apparatus according to the fourth embodiment, the drawing corresponding to FIG. 7.
Figure 19:
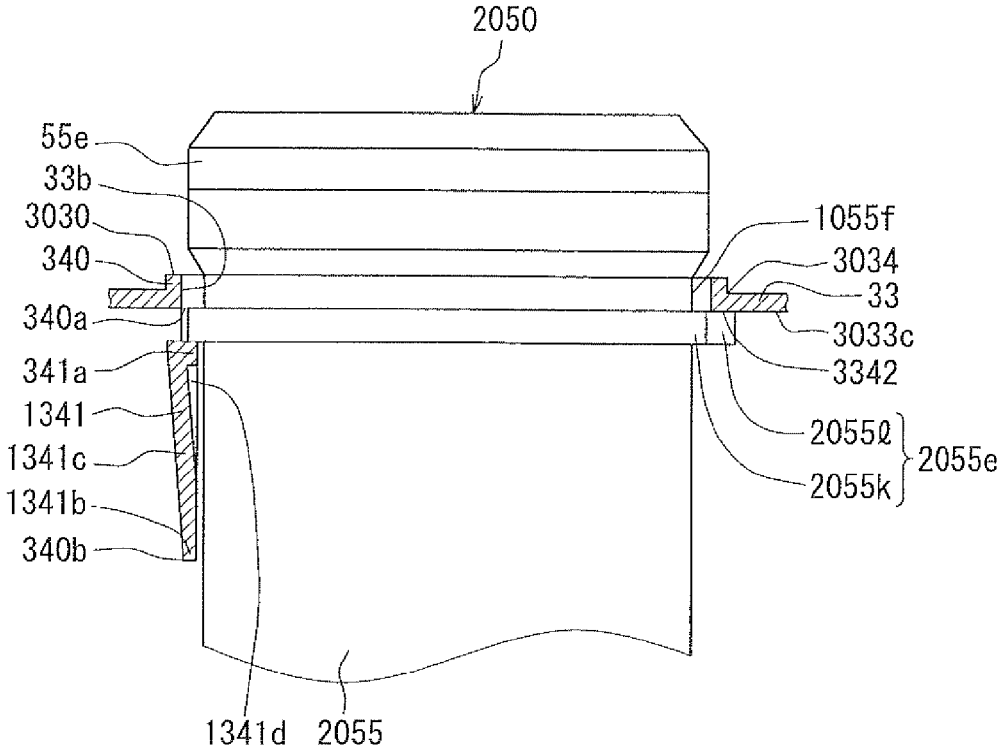
FIG. 19 is a sectional view showing the lid member and a pump unit assembled in the fuel feed apparatus according to the fourth embodiment, the drawing corresponding to FIG. 8.

The fourth embodiment being a modification of the third embodiment will be described with reference to FIGS. 18 to 19. As shown in FIG. 18, 19, a holding portion 3034 of a lid member 3030 according to the fourth embodiment includes fitting surface portions 3342. The fitting surface portions 3342 are defined by a lower surface 3033*c* of the annular plate portion 33 located around the through hole 33*b*. The through hole 33*b* is connected with the holding main body 340. The fitting surface portions 3342 (fitting elements) are located at multiple locations each being shifted from corresponding one of the elastic pieces 1341 in the circumferential direction of the connection body (holding main body) 340 and the through hole 33*b*. Each of the fitting surface portions 3342 is in a flat shape. The fitting surface portions 3342 is a part of the lower surface 3033*c* being substantially perpendicular to the axial direction. In the present structure, each of the fitting surface portions 3342 on the upper side is fitted with corresponding one of the projections 20551 of the projected portion 2055*e* to be in a surface-contact state. Thereby, the projected portion main body 2055*k* of the projected portion 2055*e* is interposed between the fitting surface portion 3342 and the upper end portion 341*a* of corresponding one of the elastic pieces 1341.

When the lid member 3030 is mounted to the filter case 2055, a series of processes described in the third embodiment is performed excluding the process shown in FIG. 17D in which each of the fitting surface portions 3342 is fitted from the upper side to the projection 20551 of each of the projected portions 2055*e*. Consequently, in the fourth embodiment, the upper end portion 341 a of each of the elastic pieces 1341 supports the projected portion 2055*e* from the lower side. In addition, each of the elastic pieces 1341 interposes the projected portion 2055*e* with corresponding one of the fitting surface portions 3342. In this state, the lid member 3030 mounted to the reservoir 20 supports the pump unit 2050 such that the pump unit 2050 is floated and supported.

In the present fourth embodiment, each of the elastic pieces 1341 and each of the fitting surface portions 3342 of the holding portion 3034 interpose the projected portion 2055*e* therebetween. In the present structure, elastic deformation of the elastic component 1341 enables damping of vibration and positioning of the supported component. Therefore, vibration of the reservoir 20 due to transmission of vibration from the pump unit 2050 can be reduced, similarly to the third embodiment. Thus, the durability of the joined portion 1055*g* can be enhanced.

Other Embodiment

As described above, the present invention is not limited to the above embodiment, and is capable of being applied to various embodiments and combinations as long as being undeviating from the gist thereof.

For example, the holding portion 34, 1034, 2034, 3034 of the lid member 30, 1030, 2030, 3030 may have various structures other than the structure for supporting the pump unit 50, 1050, 2050 from the lower side using the elastic piece 341, 1341, as described in the first to fourth embodiments. For example, the holding main body 340 may directly support the pump unit 50, 1050, 2050.

The elastic nails 342, 1342 or the fitting elements 2342, 3342 may be omitted from the holding portion 34, 1034, 2034, 3034 of the lid member 30, 1030, 2030, 3030. The holding portion 34, 1034, 2034, 3034 of the lid member 30, 1030, 2030, 3030 may support various portions of the pump unit 50, 1050, 2050 other than the upper portion as described in the first to fourth embodiments. The holding portion 34, 1034, 2034, 3034 may support an intermediate portion or a lower portion of the pump unit 50, 1050, 2050 in the vertical direction (axial direction) using the holding portion 34, 1034, 2034, 3034. Instead of the projected portion 2055*e*, the projection 20551 may be provided to the projected portion 55*e* in the holding portion 2034, 3034 according to the third and fourth embodiments. In this case, the projected portion 55*e* may be interposed between the elastic nails 1341 and the fitting element 2342, 3342. The holding portion 34, 1034, 2034, 3034 of the lid member 30, 1030, 2030, 3030 may support the pump unit 50, 1050, 2050 such that the pump unit 50, 1050, 2050 is at least partially in contact with the bottom portion 20*a* of the reservoir 20.

Summarizing the above embodiments, the furl feed apparatus includes: the bottomed tubular reservoir located in the fuel tank; the lid member located in the fuel tank and mounted to the periphery of the opening of the reservoir to close the opening; and the pump unit located in the fuel tank and supported by the holding portion of the lid member for discharging fuel stored in the reservoir to the exterior of the fuel tank.

In the present structure, the lid member located in the fuel tank is mounted to the periphery of the opening of the reservoir to block the opening. Therefore, even when the vehicle inclines rapidly relative to the horizontal surface, the lid member may avoid leakage of fuel from the opening. In the present structure, the pump unit supported by the holding portion of the lid member may cause vibration when discharging fuel through the lid member. The vibration of the pump unit may be transmitted to the reservoir through the lid member. In the above-noted structure, such transmission of vibration can be restricted by reducing the height of the reservoir in the vertical direction as much as possible. In addition, the lid member closing the opening of the reservoir has a wide area. Therefore, stress caused by supporting the becomes small. Thus, rigidity of the lid member may be set small to reduce vibration, which causes wobble in the reservoir.

The lid member may include the annular plate portion and the mount portion. In this case, the annular plate portion may be in a ring-plate shape to have the inner periphery connected with the holding portion. The mount portion may be connected to the outer circumferential periphery of the annular plate portion and mounted to the periphery of the opening of the reservoir. In this case, the holding portion supporting the pump unit is connected to the inner periphery of the lid member. In addition, the annular plate portion has the outer periphery connected with the mount portion. The mount portion is mounted to the periphery of the reservoir defining the opening. The annular plate portion is formed in a ring-plate shape to have a wide area. Therefore, stress caused due to supporting the pump unit becomes small. In the present structure, the rigidity of at least the annular plate portion may be reduced in the lid member so as to attenuate vibration transmitted from the pump unit to the reservoir through the annular plate portion.

The holding portion may support the pump unit to float the pump unit at the position distant from the bottom portion of the reservoir. In the present structure, wobble of the reservoir due to vibration transmitted from the pump unit can be reduced by supporting the pump unit using the holding portion of the lid member to float the pump unit at the position distant from the bottom portion of the reservoir.

The holding portion may include an elastic piece formed on the lateral side of the pump unit and elastically deformable. In this case, the holding portion may support the pump unit from the lower side by using the upper end portion of the elastic piece. In the present structure, in which the holding portion of the lid member supports the pump unit from the lower side via the upper end portion of the elastic piece, the elastic piece may be elastically deformed to attenuate vibration transmitted from the pump unit to the upper end portion. In addition, the pump unit is in contact with the elastic piece to cause elastic deformation in the elastic piece. Thereby, the elastic piece enables attenuation of vibration to the lateral side caused in the pump unit as a vibration source. In the present structure, wobble caused in the reservoir due to vibration transmitted from the pump unit can be further reduced.

The pump unit may have a projected portion projected to the lateral side at the upper portion. In this case, the holding portion may support the projected portion from the lower side using the upper end portion of the elastic piece. In the present structure, the holding portion of the lid member supports the projected portion, which is projected from the upper portion of the pump unit to the lateral side, from the lower side by using the upper end portion of the elastic piece. Therefore, the barycenter position of the pump unit may be easily set downward relative to the support position at which the projected portion is supported by the elastic piece. The configuration of the barycenter position being set downward results in reduction in vibration caused in the pump unit. Therefore, wobble of the reservoir due to vibration transmitted from the pump unit can be effectively reduced.

The pump unit may include the case formed with the projected portion away from the lateral side of the joined portion joined with the included element (e.g., filter element). In the present structure, the holding portion of the lid member supports the projected portion using the elastic piece. The projected portion is formed to be away from the lateral side of the joined portion of the case of the pump unit. The joined portion is joined with the included component. Even when the case is deformed due to joining with the included component, the projected portion can steadily support the pump unit by using the elastic piece in this way. Therefore, the elastic piece can steadily reduce transmission of vibration to the lateral side of the pump unit. Thus, wobble of the reservoir due to transmission of vibration from the pump unit can be steadily reduced. In addition, even if counter force works on the projected portion of the case when being supported by the elastic piece, the counter force hardly works on the joined portion, which is away from the lateral side of the projected portion. Therefore, the durability of the joined portion can be enhanced.

The holding portion may have the elastically deformable elastic nail formed to interpose the projected portion with the upper end portion of the elastic piece. In the present structure, the holding portion of the lid member causes the upper end portion of the elastic piece and the elastic nail to interpose the projected portion of the pump unit therebetween. Therefore, the elastic piece and the elastic nail elastic deform to attenuate steadily vibration of the pump unit. Thus, wobble caused in the reservoir due to vibration transmitted from the pump unit can be further reduced.

The projected portion may include the projection element. The projection element further projects from the projected-side tip end to the lateral side. In this case, the holding portion may include the fitting element. The fitting element is fitted to the projection element from the upper side. Thereby, the fitting element and the upper end portion of the elastic piece interpose the projected portion therebetween. In the present structure, the projection element is further projected to the lateral side from the projected-side tip end of the projected portion of the pump unit. The holding portion of the lid member causes the upper end portion of the elastic piece and the fitting element to interpose the projection element therebetween. Therefore, vibration of the pump unit can be steadily attenuated by elastic deformation of the elastic piece. Thus, wobble caused in the reservoir due to vibration transmitted from the pump unit can be further reduced.

The pump unit may include the case including two components joined in the vertical direction. The projected portion is formed to be away from the joint interface between the two components. In the present structure, the holding portion of the lid member causes the elastic piece and the elastic nail or the fitting element to interpose the projected portion therebetween. The projected portion is formed to be away (offset) from the joint interface between the two components in the pump unit. In this way, even when the case is deformed by joining the two components, the projected portion can be steadily interposed by the components of the lid member. Therefore, wobble of the reservoir due to vibration transmitted from the pump unit can be reduced.

When only a part of a structure of an element is described in an embodiment, other part of the structure of the element in another foregoing embodiment may be applied to the embodiment. The combinations of the components are not limited to those in the above-described embodiments. The components in different embodiments may be partially or entirely combined, as long as the components can be properly combined, even if such a combination is not explicitly described.

It should be appreciated that while the processes of the embodiments of the present invention have been described herein as including a specific sequence of steps, further alternative embodiments including various other sequences of these steps and/or additional steps not disclosed herein are intended to be within the steps of the present invention.

Various modifications and alternations may be diversely made to the above embodiments without departing from the spirit of the present invention.

What is claimed is:

1. A fuel feed apparatus comprising:

a reservoir being in a bottomed tubular shape and located in a fuel tank;

a lid member located in the fuel tank and mounted to a periphery of an opening of the reservoir to close the opening; and a pump unit located in the fuel tank and configured to discharge fuel stored in the reservoir to an exterior of the fuel tank, the pump unit being supported by a holding portion of the lid member, wherein the holding portion supports the pump unit to float the pump unit at a position spaced from a bottom portion of the reservoir, the pump unit includes a fuel pump and a suction filter which are integrated with each other, the suction filter is located at the lowermost portion of the pump unit, and is floated to be spaced from the bottom portion of the reservoir, the holding portion includes an elastic piece being elastically deformable and located on a lateral side of the pump unit, the elastic piece of the holding portion has an upper end portion supporting the pump unit from a lower side, the pump unit includes an upper portion having a projected portion projected radially outward from the upper portion of the pump unit, the upper end portion of the elastic piece of the holding portion supports the projected portion from the lower side, the projected portion has a projected-side tip end from which a projection element is further projected radially outward from the projected-side tip end, the holding portion includes a fitting surface portion configured to be fitted to the projection element from an upper side to interpose the projected portion with the upper end portion of the elastic piece, and the projected-side tip end of the projected portion is interposed between the fitting surface portion and the upper end portion of the elastic piece.

2. The fuel feed apparatus according to claim 1, wherein the lid member includes:

an annular plate portion being in an annular-plate shape and has an inner periphery connected with the holding portion; and a mount portion connected to an outer periphery of the annular plate portion and mounted to the periphery of the opening of the reservoir.

3. The fuel feed apparatus according to claim 1, wherein the pump unit includes:

a case having the projected portion and a joined portion; and an included element accommodated in the case, and the projected portion is away from a lateral side of the joined portion, wherein the joined portion is joined with the included element.

4. The fuel feed apparatus according to claim 1, wherein the holding portion has an elastic nail being elastically deformable, and the elastic nail and the upper end portion of the elastic piece interpose the projected portion therebetween.

5. The fuel feed apparatus according to claim 4, wherein the pump unit includes a case including two components joined in a vertical direction to define a joint interface therebetween, and the case has the projected portion away from the joint interface.

6. The fuel feed apparatus according to claim 1, wherein the holding portion includes a holding main body having a projected piece projected downward, and the elastic piece being elastically deformable and supported by the projected piece, and the holding portion supports the projected portion from the lower side by the upper end portion of the elastic piece, where the upper end portion is supported by the projected piece of the holding main body toward the upper side.

7. The fuel feed apparatus according to claim 6, wherein the fitting surface portion has a flat shape.

8. The fuel feed apparatus according to claim 2, wherein a part of the fitting surface portion is a lower surface of the annular plate portion that is substantially perpendicular to an axial direction of the pump unit.

* * * * *